US008322730B2

(12) United States Patent
Sorenson

(10) Patent No.: US 8,322,730 B2
(45) Date of Patent: Dec. 4, 2012

(54) HINGED ROTATABLE BINDING SYSTEM FOR SNOWBOARDS

(75) Inventor: Kurt Bryce Sorenson, Albuquerque, NM (US)

(73) Assignee: Snowboard Sport Solutions, LLC, Albuquerque, NM (US)

( * ) Notice: Subject to any disclaimer, the term of this patent is extended or adjusted under 35 U.S.C. 154(b) by 255 days.

(21) Appl. No.: 12/433,380

(22) Filed: Apr. 30, 2009

(65) Prior Publication Data

US 2009/0273163 A1 Nov. 5, 2009

Related U.S. Application Data

(60) Provisional application No. 61/049,390, filed on Apr. 30, 2008.

(51) Int. Cl.
*B62B 9/04* (2006.01)
*A63C 9/00* (2006.01)

(52) U.S. Cl. ..... 280/14.24; 280/14.22; 280/628; 280/613

(58) Field of Classification Search ..... 280/613, 280/628, 618, 14.24, 14.22, 626
See application file for complete search history.

(56) References Cited

U.S. PATENT DOCUMENTS

| | | | | |
|---|---|---|---|---|
| 3,834,723 | A * | 9/1974 | Erlebach | 280/613 |
| 4,027,896 | A * | 6/1977 | Frechin et al. | 280/618 |
| 4,165,887 | A * | 8/1979 | Bunn, Jr. | 280/613 |
| 5,584,492 | A * | 12/1996 | Fardie | 280/14.22 |
| 5,667,237 | A * | 9/1997 | Lauer | 280/607 |
| 5,813,689 | A * | 9/1998 | Mansure | 280/607 |
| 5,855,390 | A * | 1/1999 | Hassell | 280/607 |
| 5,901,975 | A * | 5/1999 | Phipps | 280/618 |
| 6,318,749 | B1 * | 11/2001 | Eglitis et al. | 280/607 |
| 7,059,614 | B2 * | 6/2006 | Cole, III | 280/14.24 |
| 2005/0194753 | A1 * | 9/2005 | Craven et al. | 280/14.24 |

* cited by examiner

*Primary Examiner* — J. Allen Shriver, II
*Assistant Examiner* — James M Dolak
(74) *Attorney, Agent, or Firm* — Luis M. Ortiz; Kermit D. Lopez; Ortiz & Lopez, PLLC

(57) ABSTRACT

A hinged rotatable binding system for snowboards that eliminates leg pain while on the chair lift and in movement through lift lines. The binding system includes a base plate which is fixed to the snowboard and a top rotating plate which is mountable to a boot binding harness. A hinge plate connects the base plate to a mid static disk. The binding system includes a latch lever which acts as a hands-free locking system that is mounted through an outer ridge of the base plate and connected to a retractable plunger. The binding system is provided with an internal hinge and a number of friction plates therefore, fewer parts are needed. The hinged rotatable binding system for snowboards is a cost effective and light weight model with simple assembly features.

25 Claims, 7 Drawing Sheets

HINGED ROTATABLE BINDING SYSTEM FOR SNOWBOARDS

APPLICATION PRIORITY

The present application is a continuation of and claims priority to U.S. Provisional Application Ser. No. 61/049,390, filed on Apr. 30, 2008, entitled "HINGED ROTATABLE BINDING SYSTEM FOR SNOWBOARDS", which is herein incorporated by reference.

TECHNICAL FIELD

Embodiments are generally related to snowboards. Embodiments are particularly related to a hinged and rotatable binding system for snowboards.

BACKGROUND OF THE INVENTION

Snowboarding is a fastest growing sport since 1997 and has become a winter sport in the United States and other countries. It is usually done on commercially operated slopes which are designed to accommodate many skiers and snowboarders. Snowboarding is similar to skiing, but inspired by surfing and skateboarding. Market research statistics during the period 1990-2004 has shown that the overall snowboarding population increased by 294 percent during this period (i.e., an average increase of 20 percent per year). Another statistics for this period (2004-2005) shows that 6.6 million tickets were sold to snowboarders. These statistics reveal vast growth and popularity of the snowboarding sport on the younger generations.

Snowboarding is a sport that involves descending a snow-covered slope on a single board, a "snowboard", attached to a user's feet using special boots held within a snowboard-mounted binding. A snowboarder uses a boot designed especially for the requirements of snowboarding. As with skiing, snowboarding requires that boots be secured to a snowboard by boot bindings.

Snowboarding generally involves the use of chair lifts to carry snowboarders from a base to a summit. At each lift there will be a line of skiers and snowboarders waiting to board the chairlift. Snowboarders experience a burden while shuffling over to the chairlift on foot because one foot (the lead foot) remains tied to the snowboard, while the other foot (rear trailing foot) is used to push the user via the snowboard over to the chairlift (similar to how a skateboarder moves himself on a skateboard). Moving by foot on a snowboard can be very tiring, painful and unattractive given the users' odd attachment by a single foot to their snowboards.

The snowboarding differs significantly from skiing. In snowboarding, rather than having separate skis for each foot and poles for each hand, both feet of a snowboarder are held, one in front of the other (or side by side with shoulder width separation), on a single, relatively wide board using a binding system including two boot bindings fixed to the top surface of the snowboard. The primary purpose of the binding system for snowboards is to hold both of the user's boots onto the snowboard during use on ski slopes. Besides that, the binding system must provide adaptability to various shoe sizes and adjustability of the angle of the boots to the longitudinal axis of the snowboard.

The general construction of a snowboard involves three basic components. They are namely the core, base, top surface and edge. A core is typically interior construction of the snowboard. The base is typically the bottom of a board that makes contact with the snow. The edge can be a strip of metal, tuned normally to just less than 90° that runs the length of either side of the board. The top surface is where the binding system is mounted and is the area that directly supports a snowboarder.

The snowboard can be a thin, hourglass shaped board that can be ridden down a ski run. Snowboards generally have a length between 140-165 cm and a width from about 24 up to 27 cm or more. The size variants are meant to accommodate many varieties of people, skill levels, snow types and riding styles. The snowboards are usually constructed with a laminated wood core sandwiched between multiple layers of fiberglass. The bottom or 'base' of the snowboard can be generally made of various materials including plastic or coated wood, and can be surrounded by a thin strip of steel as the 'edge'. The top surface layer can include printed graphics and can be coated with an acrylic. Bindings are separate components from the snowboard top surface (e.g., or "deck") though they are a very important part of the total snowboard interface. The main function of the binding is to hold the riders boot in place tightly so the rider can transfer their energy to the board.

A chairlift is a type of aerial lift, which comprises of a continuously circulating steel cable loop strung between two end terminals and usually over intermediate towers, carrying a series of chairs. Chair-lift is an on hill transport generally used to travel across various posts.

Passengers moving towards for boarding or traveling on a chair lift need to take necessary precautions to avoid injuries. When the passengers are in a stance position and shuffling towards a chair lift for a ride, they need to adjust the bindings accordingly to alleviate pain in ankles and knees. Snowboards can generally provide up to 45° rotation between the toe areas of each of the bindings that are mounted on a snowboard. The binding positions generally remain fixed once set. The binding position associated in such snowboards can be painful and uncomfortable while a snowboarder is moving along in lift lines and while riding on a chair lift. The stance of the user may look awkward and unnatural. Ideally, binding adjustment should be enabled when the snowboarder is in stance position shuffling over to a chair lift or while riding on a chairlift in order to alleviate pain in the snowboarder's knee and the ankle of the leg that a snowboard can remain tethered to while the snowboarder is dealing with chairlift usage.

The present inventor has created a snowboard binding that can be rotated and that is hinged in order to alleviate pain experienced in a user's leg as it remains tethered to the snowboard during chairlift approach or while standing in chairlift lines, and from dangling snowboards from a user's leg while the user is riding a chairlift. The majority of prior art binding systems do not focus on managing the impact of chairlift wind and the snowboard load on user's foot. The lack of a hands free locking and release system limits the capability of prior art snowboards. There is currently no rotatable binding system for the snowboards which can ease the load on user's foot while shuffling along in chairlift lines as well as when riding on a chairlift. Consequently the snowboard load causes stress on knee and ankle and causes an awkward stance by snowboarders while they move along through lift lines. Similarly the binding position while in lift lines and on the chair lift associated with such systems is painful and its pulling force while tethered by a binding to the user is unnatural for lead ankle. The cascading effect typically results in a binding position which is painful and cumbersome for users while in lift lines and on the chair lift.

Furthermore, if two users are sitting next to each other on a chairlift, and they use opposite boots as their front boot, the twisting of their legs due to their respective bindings can cause their snowboards to collide with each other. This is not only painful, but may also be potentially dangerous. Similarly getting off a chair lift can also be troublesome because the angle at which the user's front boot is bound to the snowboard can make it difficult for the user to position the snowboard in line with forward movement of the chair lift to the point of dismount from the chairlift by the snowboarder. If the snowboard is not positioned in a forward direction with movement of the chair lift as the snowboard touches the ground, the user can veer off to one side and run into the person next to the disembarking snowboarder who had been sharing the chair lift. Hence, an improved snowboard binding system is needed in order to provide greater safety and comfort for snowboarders while in lift lines and on the chair lift.

Based on the foregoing it is believed that a need therefore exists for an improved snowboard binding system that eliminates rotation at the knee and flexion at the ankle which is incorporated with a hands free locking system. It is also believed a need exists for the snowboard binding system to reduce discomfort and injury when loading and unloading from chairlift.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for improved snowboarding binding system.

It is another aspect of the present invention to provide for improved rotating binding system.

It is a further aspect of the present invention to provide for improved hands-free locking system.

It is, therefore, one aspect of the present invention to provide for an improved snowboard binding system that eliminates rotation at the knee or flexion at ankle.

It is another aspect of the present invention to provide for an improved snowboard binding system that will rotate the front binding to a parallel position for ease of mobility.

It is a further aspect of the present invention to provide for an improved snowboard binding system that is incorporated with a hands free locking system.

The aforementioned aspects and other objectives and advantages can now be achieved as described herein. A hinged rotatable binding system for snowboards that eliminates leg pain while on the chair lift and in movement through lift lines is disclosed. The binding system includes a base plate which is fixed to the snowboard and a top rotating plate which is mountable to a boot binding harness. A hinge plate connects the base plate to a mid static disk. The binding system includes a latch lever which acts as a hands-free locking system that is mounted through an outer ridge of the base plate and connected to a retractable plunger. The binding system is provided with an internal hinge and a number of friction plates therefore, fewer parts are needed. The hinged rotatable binding system for snowboards is a cost effective and light weight model with simple assembly features.

Connectors such as locking dowels can connect the hinge plate with the mid static disk and mounts the latch lever with the base plate. A base plate bolt connects the base plate with the snowboard. A central axis bolt mounts the top rotating disk to the mid static disk. The hinge plate of the rotatable binding system is open while user is riding the chairlift. The hinge plate enables the snowboard to rotate away from user's foot attachment to the binding. The base plate connected by hinge plate to static disk, supports rotating of the disk thereon. The materials used in the snowboard binding system are to be non-corrosive, light weight, strong and durable.

The snowboard binding system can comprise of a rotating disk which is connected to a mid-static disk using a number of shoulder bolts. The rotating disk along with the mid-static disk is connected to a base plate of the binding system using a hinged plate. The hinge plate enables the snowboard to rotate away from user's foot attachment to the binding using double hinge action. A plunger can be used to connect the hinge plate with the rotating disk and the mid-static disk. A lock base plate is connected to one end of the base plate which uses a spring plunger to lock and unlock the binding system. The rotating disk can rotate up to 90° when the binding system is unlocked to alleviate pain in the ankle and the knee when the snowboarder is in lift lines or chair lift. The snowboard binding system is a rotational hinged system. Such binding system comprises of less number of parts as it uses friction plates. The snowboard binding system is non-corrosive, durable, cost-effective and easy to use. According to the comfort of the user the binding can be rotated to 90° which alleviates torque and movements on the ankle while on the lift.

A hinged rotatable binding system for snowboard can comprise a base plate that is mounted on a surface which is in direct contact with the snowboard. A mid static plate can be connected with the base plate through a plurality of dowel axis. The dowel axes are colligated with a lock base plate and a plunger to provide hands free locking system. A rotating disk is mounted on the mid-static disk which is attached with a hinge plate and a plurality of screws and screw-receiving holes that are utilized to integrate the binding system. The binding system enables the snowboard to rotate away from user's foot that is parallel to the longitudinal axis of the snowboard which eliminates rotation at knee and/or flexion at ankle.

The snowboards are incorporated with the binding system that rotates up to 90° due to the hinge and the rotating disk attached to the base plate. The rotating disk eliminates twist in the ankle and on the torque of user while on lift line and/or chair lift. The lock base plate is utilized for hands free locking system. The lock can be released by the foot stamped down when the user is on chair lift so that the binding system may be elevated to feel user comfortable on the chair lift. The snowboards binding system are cost effective and the material utilized is light weight so that it is easy to handle.

The system includes friction plates hence fewer parts are needed which in turn leads to a simple and a light weight system. The manufacturing process and assembly is simple and cost effective, thus providing a system that is feasible. The hinged, rotatable binding system relieves stress during ankle dorsiflexion, the movement which decreases the angle between the foot and the leg and during ankle supination in the foot, which occurs when a person appears with their weight supported primarily on the anterior of their feet. The hinged, rotatable binding system also eases mobility by rotating the front binding to parallel position.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

There are generally two types of snowboard bindings used for a soft snowboard. A strap binding typically includes one or more straps that extend across the rider's boot to secure the boot to the binding. In contrast, step in binding typically employs one or more strapless engagement members, rather than straps, into which rider can step to lock the boot into binding. The strapless engagement members are configured to engage with one or more corresponding engagement members on the boot. Some riders may find a strap binding inconvenient because a rider must unbuckle each strap of the rear binding after each run to release the rear boot when getting on a lift and must subsequently re-buckle each strap before the next run.

The problems associated with prior art binding systems, when moving on level areas, and into and through chair-lift lines, is that the snowboarder has to remove the back foot from its binding, leave forward foot fixed into its binding in the transverse position, and then try to propel himself or herself on the snowboard along in a scooter/skateboard fashion. With the forward foot locked in the pre-selected transverse position and the other foot out of the binding, even a casual observer can see the front foot (and thus the front leg) is contorted to one side, forcing the snowboarder to walk in an extremely pigeon-toed manner. This obviously results in undue stresses to the snowboarder's joints and body.

In addition, for the same reason, while the snowboarder is riding chair-lifts with other skiers, the snowboard tends to hang at a sideways angle, rather than pointing straight forward in a position parallel with the skis of the other riders on the chair-lift. Here again, the snowboard often bangs into or on top of adjacent skis much to the discomfort of skiers since chipping and scratching of their equipment can and does occur. Such snowboard binding systems tend to look extremely uncomfortable, cumbersome with awkward stance position and hard to maneuver. When snowboarders are moving along in chair-lift lines, or riding up on chair-lifts, they lack dignity and style due to the extremely awkward, pigeon-toed (transverse foot) positioning of their feet. Another problem with the snowboard binding systems is that they tend to cause physical discomfort and injury. Snowboarders experience stress to their joints from undue torque and strain on their ankle and knees.

Figure 1A:
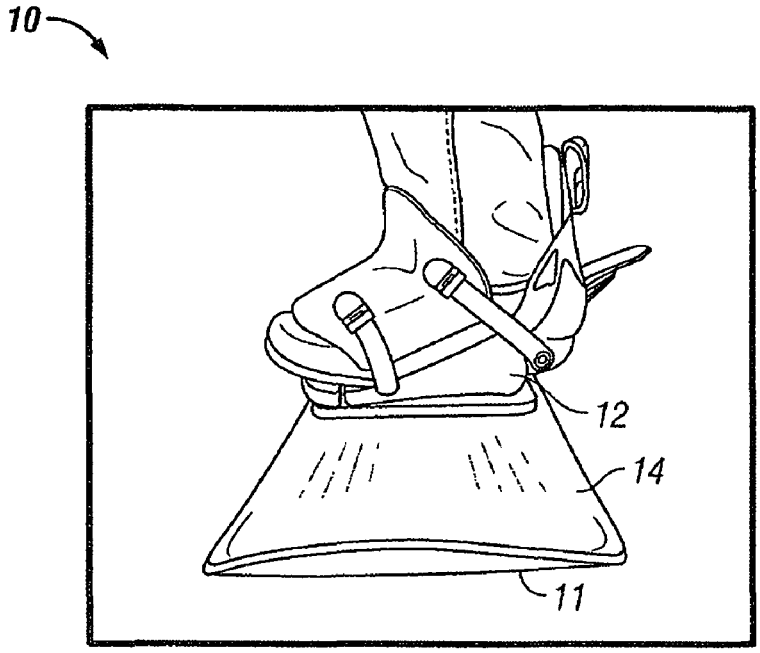
FIG. 1A (Prior Art)
FIGS. 1A and 1B, labeled as "Prior Art", illustrate a prior art implementation of a snowboard system.
Figure 1B:
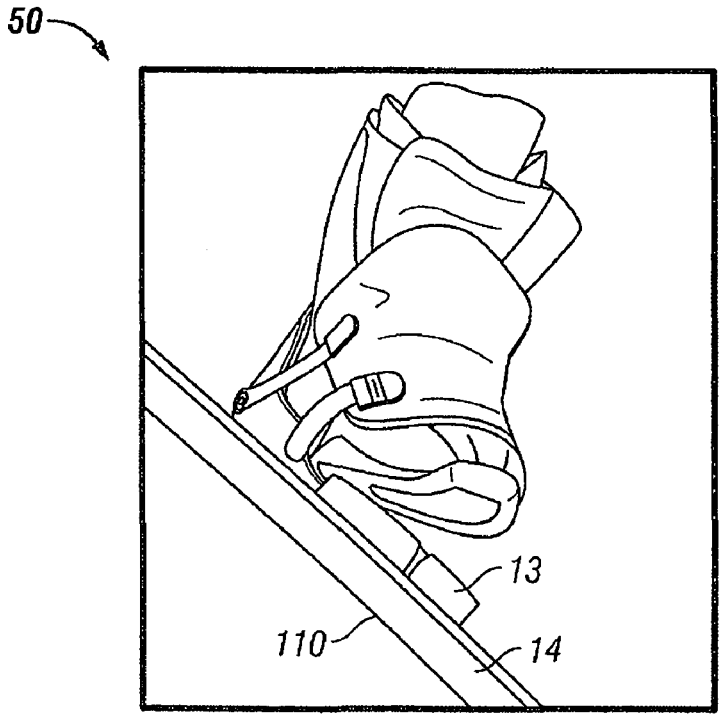
FIG. 1B (Prior Art)

Referring to FIG. 1A and FIG. 1B, labeled as "Prior Art", a conventional orientation of user positions 10 and 50 while standing in chair-lift line and while riding chair lift using prior art snowboard binding systems is illustrated. The snowboard 11 with an incorporated binding system 14 allows user to bind his/her feet to the snowboard 110. The user position 10 while standing in chair-lift line may be painful because user's front boot is bound to the base of the snowboard 110 at an awkward angle 12.

As depicted in FIG. 1B, position of user 50 while riding chair-lift, is illustrated. The snowboard with incorporated binding system 14 that allows user's foot to bind to the snowboard 110. The position of user 13 while riding chair lift may be uncomfortable and dangerous because the longitudinal axis of the user's front boot is substantially non-parallel to the longitudinal axis of the snowboard 110.

Figure 2:
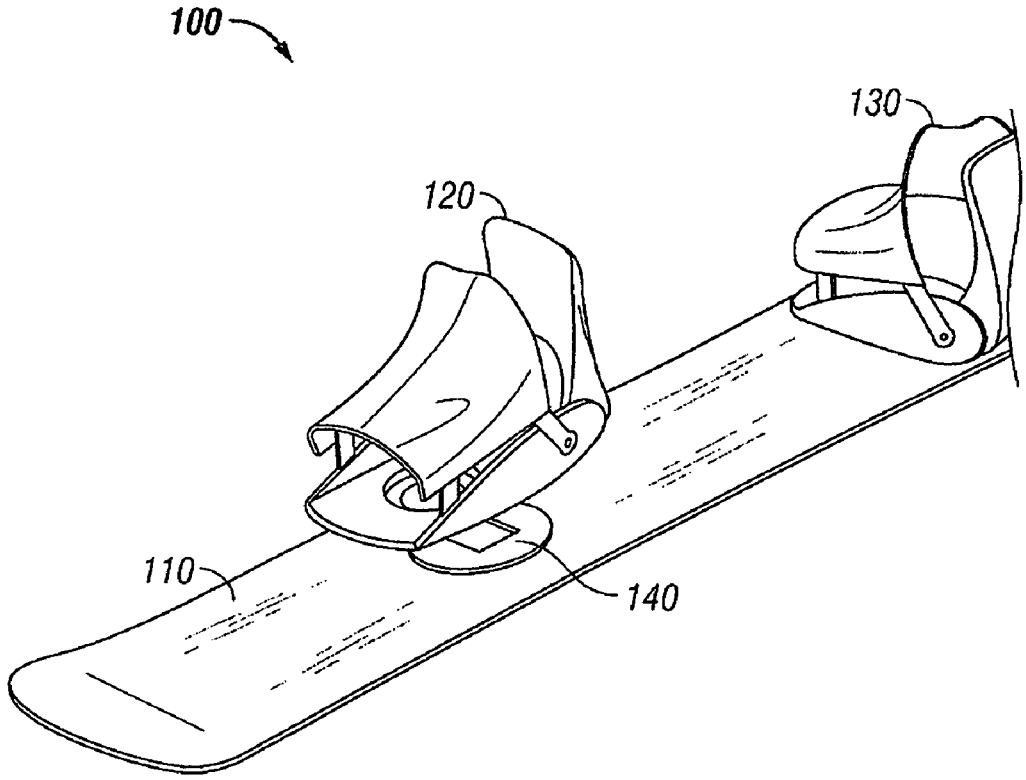
FIG. 2 illustrates an perspective view of a snowboard with a rotatable binding system which can be implemented in accordance with a preferred embodiment.

FIG. 2 illustrates a perspective view of a snowboard 100 with a binding system 140 which can be used for coupling the baseboard 110 and a front soft shoe 120. The baseboard 110 can be a thin hourglass shaped board ridden down a sloped section of earth covered in snow. The binding system 140 of the snowboard 100 is a non corrosive, light weight and strong system which is made of materials like 01 tool steel, 6061 aluminum, and magnesium. The back soft shoe 130 of the snowboard 100 is fixed to the baseboard 110 with out any rotating action. The front soft shoe 120 which is coupled with the binding system 140 can provide a rotational angle through which the user can provide the elastic deformation of the snowboard 100 unrestrictedly in every direction while gliding.

Figure 3A:
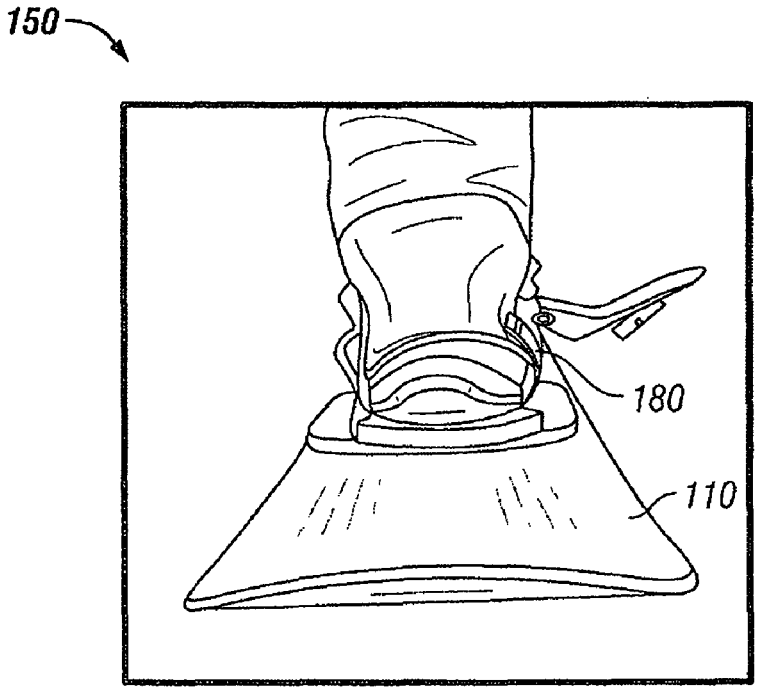
FIGS. 3A and 3B illustrates an implementation of a skilled rotational binding system in the snowboards while the user is standing in the chair-lift line and riding a chair lift, in accordance with a preferred embodiment.
Figure 3B:
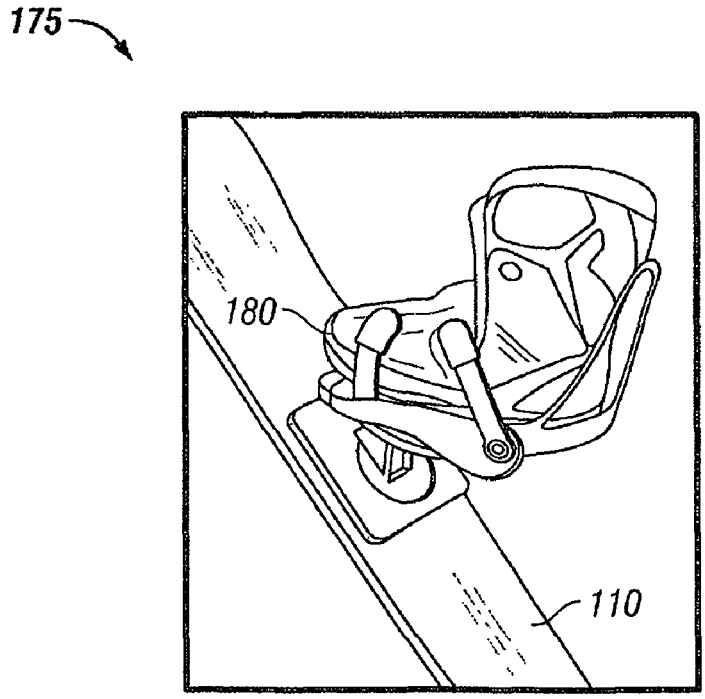

FIGS. 3A and 3B illustrates an implementation of a hinged rotatable binding system 150 and 175, respectively, on the base 110 while the user is standing in the chair-lift line and riding a chair lift, in accordance with a preferred embodiment. The position of the user's foot when standing in the chair-lift line using the skilled rotatable snowboard system 150 is depicted in FIG. 3A. The snowboard 150 with an incorporated hinged rotatable binding 180 allows user to bind his/her feet to the snowboard 110. Hence, the position of user while standing in chair-lift line may be comfortable because user's front boot is bound to the snowboard 110 at a desired angle.

As depicted in FIG. 3B position of the snowboard and hinged rotatable binding system 175 on a user while riding chair-lift is illustrated. The snowboard 110 with incorporated binding system 180 allows user to bind user's feet into the snowboard 110. The position of user while riding chair lift may relieve stress from ankle and knee because the longitudinal axis of the user's front boot is substantially parallel to the longitudinal axis of the snowboard 110.

Figure 4:
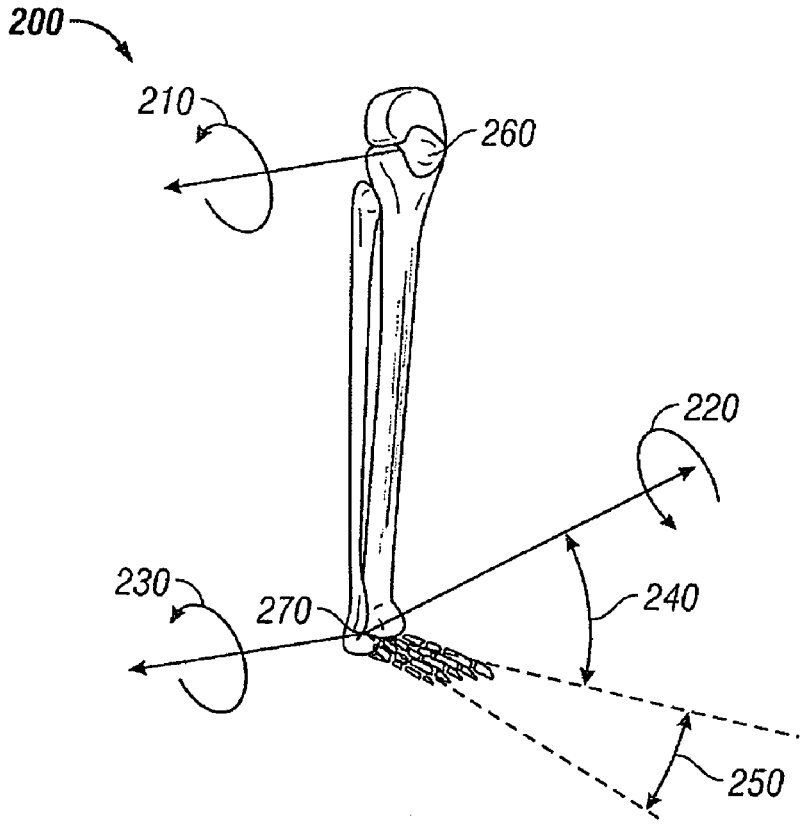
FIG. 4 illustrates an anatomic view of a human leg which illustrates the action of torque on knee and ankle which can be implemented in accordance with a preferred embodiment.

FIG. 4 illustrates an anatomic view 200 of a human ankle and knee where the binding system 200 reviles the stress. The knee extension 210 as depicted in FIG. 2 is a three dimensional view of the extension provided to the human knee 260 by the binding system 200. The knee extension 210 which is in rotational upward direction reveals the torque over the human knee 260. The ankle supination 220 is another three dimensional view of the supination provided to the human ankle 270 by the binding system 200. The ankle supination on the human ankle 270 tends towards downward direction. The angle of ankle supination 240 is the maximum supination that is provided by the binding system 200 which can be an angle of forty-five degrees to the maximum as depicted in the FIG. 2. The ankle dorsiflexion 230 is a moment that decreases the angle between the foot and the leg. The medial rotation angle 250 of FIG. 4 is the maximum angle that is provided by the binding system 140 which can be an angle of twenty-three degrees to the maximum. Thus, the binding system 140 alleviates the torque and moments on the human ankle 270 while on the lift.

Figure 5:
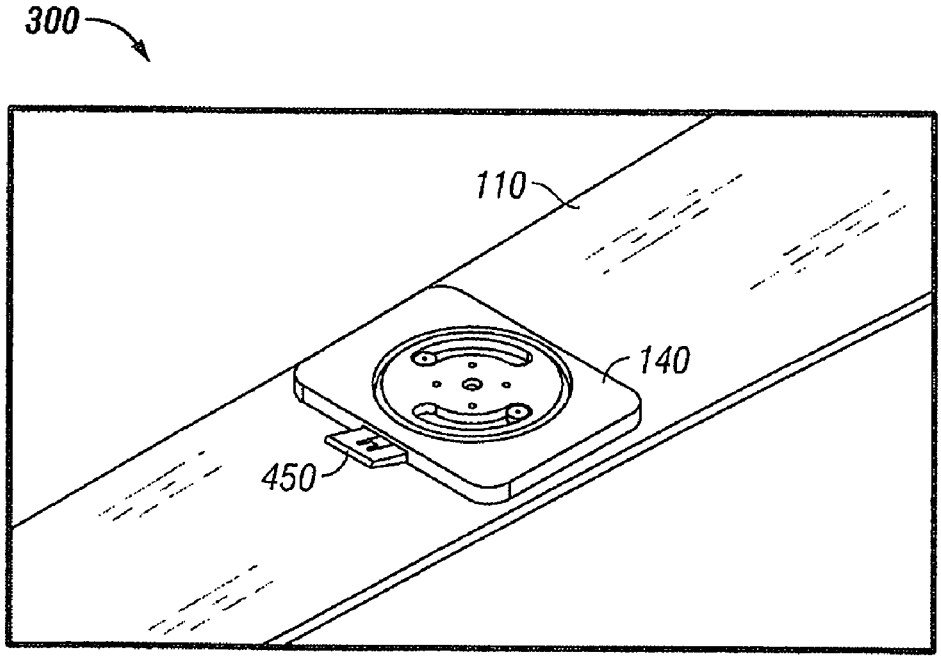
FIG. 5 illustrates an general view of shag assembly of the hinged rotatable binding system, which can be implemented in accordance with a preferred embodiment.

FIG. 5 illustrates the binding system assembly 300 of the snowboard 100. The baseboard 110 is coupled with the base plate 495 of the binding system 300. The binding system 300 includes the latch lever 450 as a locking system through which the user can lock and unlock the binding system automatically. Further, the soft front shoe 120 is to be coupled with the binding system 300.

Figure 6:
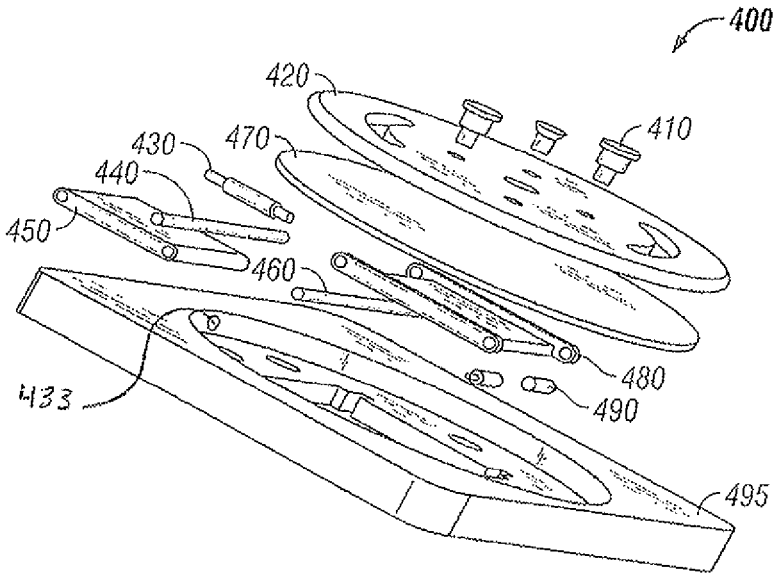
FIG. 6 illustrates an exploded view of the snowboard binding system which illustrates the parts involved in assembly of a snowboard binding system, which can be implemented in accordance with a preferred embodiment.

FIG. 6 illustrates an exploded view of the binding system 400. The binding system 400 includes a number of center axis bolts such as center axis bolt 410 which can be used to mount the top rotating disk 420 to the mid static disk 470. The top rotating disk 420 is mounted with the front soft shoe 120 which can provide a rotational angle to the user. The mid static disk 470 further supports in rotation of the top rotating disk 420. The retractable plunger 430, which can be provided in the form of a locking dowel, can be mounted through a hole 433 formed in the base plate 495 between the latch lever 450 and its retractable connection with the top slot 425 formed in the outer perimeter of the rotating disk 420. The hinge plate 480 can be used to connect the base plate 495 with the mid static disk 470.

The latch lever 450 is connected to the outer ridge of the base plate 495 and is further held to the base plate 495 through a hole 433 formed in the base plate 495 by a retractable plunger 430 and operates the retractable plunger 430 to interact with and secure the rotating disk 420 within the base plate 495. The upper dowel axis 440 connects the hinge plate 480 with the mid static disk 470. The lower dowel axis 460 connects the hinge plate 480 with the base plate 495. The base plate 495 holds the entire assembly on it is used to couple the binding system 140 with the base board 110.

Figure 7:
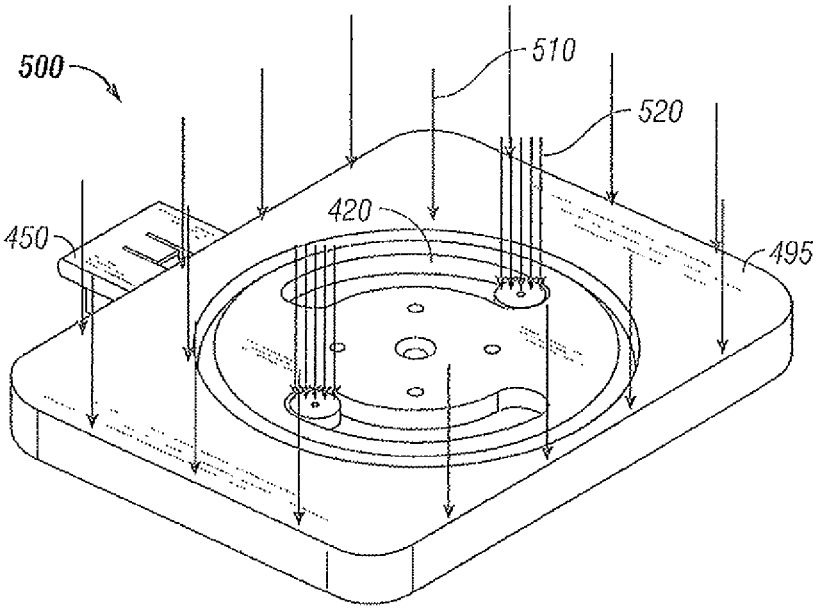
FIG. 7 illustrates an perspective view of the snowboard binding system with force distribution, which can be implemented in accordance with a preferred embodiment.

FIG. 7 illustrates the force distribution and force application on the binding system 500. The force applied on the binding system 500 is calculated by plotting on a three dimensional plane considering the axis of the planes as X-axis, Y-axis, and Z-axis. The base plate 495 of the binding system 500 is sensed with a distributed a force as such a force 510 as illustrated in the FIG. 5. The distributed force 510 which is applied on the base plate 495 is 0 along both X-axis and Y-axis and 2752 on the Z-axis. An even force 520 is sensed by the top rotating plate 420 of the binding system 500. The even force 520 along X-axis and Y-axis is 0 and 2752 on the Z-axis. The force sensed by the latch lever 450 of the binding system 500 is zero. There is no force acting on the binding system 500 in either X-axis or Y-axis thus, the user feels comfortable with using the binding system 500.

Figure 8:
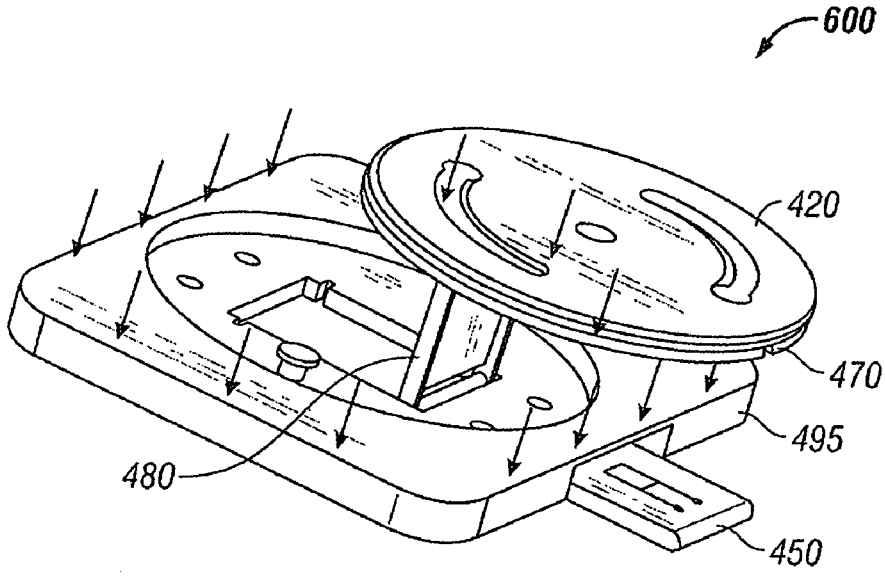
FIG. 8 illustrates a perspective view of a base plate connected by the hinge plate to static disk, supporting a top rotating disk, which can be implemented in accordance with a preferred embodiment.

FIG. 8 illustrates a perspective view of binding system 600 of which the base plate 495 is connected by the hinge plate 480 to the mid static disk, supporting a top rotating disk 420. The base plate 495 of the binding system 600 is connected by the hinge plate 480 to the mid static disk 470, supporting the rotating disk 420 thereon. The latch lever 450 is attached to side of the base plate 495. The maximum displacement that is provided at the latch lever 450 can be 6.515E-06 in. The maximum von Mises stress, which is the stress at which the binding system 600 begins to deform, is 417.6 psi. The binding system 600 withholds a high von Mises stress thus, holds a durable capability.

Figure 9:
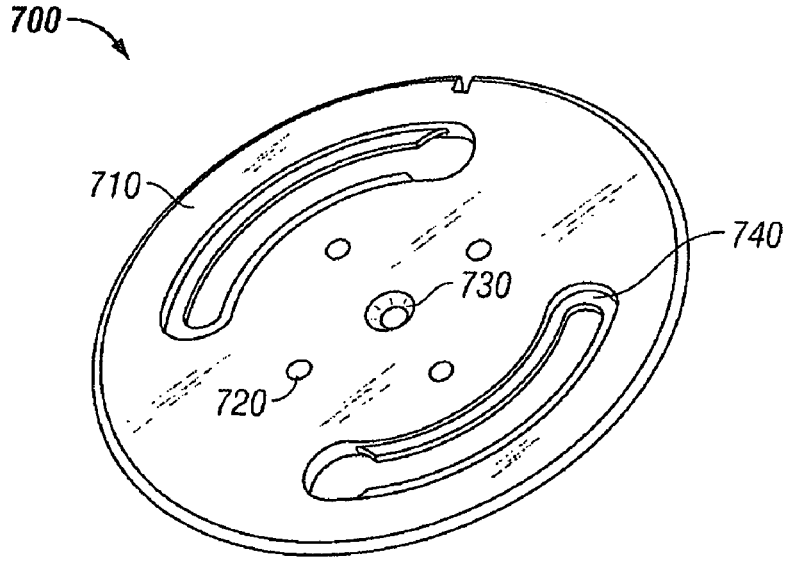
FIG. 9 illustrates a perspective view of the top rotating disk which can be attached at center point to a mid static disk, which can be implemented in accordance with a preferred embodiment.

FIG. 9 illustrates the perspective view of the top rotating disk 900. The center point 730 is used to attach the top rotating disk 420 with the mid static disk 470. The displacement of the binding system 140 is concentrated on the base 710 of the top rotating disk 420. The base 710 of the binding system can withhold a maximum displacement of +4.0403E-06. The number of pivot holes such as pivot 720 is used to couple the front soft shoe 120 with the binding system 140.

Figure 10:
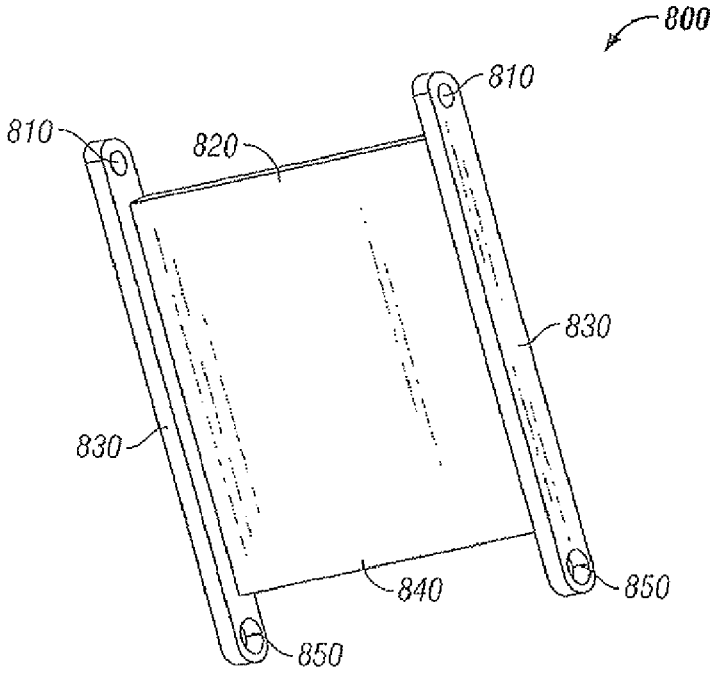
FIG. 10 illustrates a perspective view of a supporting hinge plate that enables double hinge action and connects the base plate with the mid static disk, which can be implemented in accordance with a preferred embodiment.

FIG. 10 illustrates the perspective view of a hinge plate 800. The hinge plate 800 enables a double hinge action and connects the base plate 495 with the mid static disk 470. The hinge plate 480 includes a pair of top holes 810 used to connect with the mid static disk 470. The hinge plate 480 includes a pair of bottom holes 850 which is used to connect it with the base plate 495. The top hole 810, the bottom hole 450 and the outer ridge 830 are the regions of the hinge plate 480 where the maximum von Mises stress is applied. The maximum von Mises stress applied on the hinge plate 800 is 5.000E+3. The upper part 820 of the hinge plate 480 and the lower part 840 of the hinge plate 480 are the regions where the von Mises stress is minimized with a value of 0.000E+0. The minimized stress extends the durability of the hinge plate 800.

The binding system 140 is provided with the hinge plate 800 and a number of friction plates therefore, fewer parts are needed. The materials used in the snowboard binding system 140 are to be non-corrosive, light weight, strong and durable. The hinged rotatable binding system 140 for snowboards 100 is a cost effective and light weight model with simple assembly features.

Figure 11:
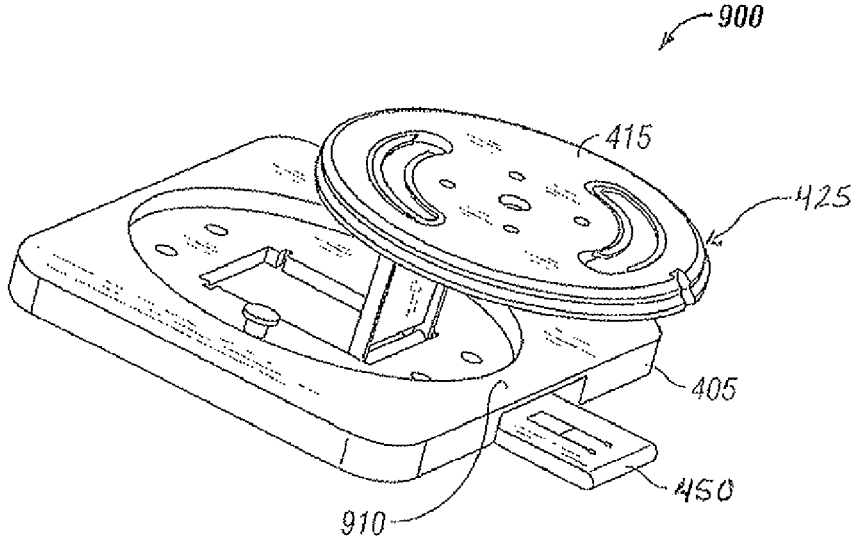
FIG. 11 illustrates a top view of the hinged, rotatable binding system shown with von mises stresses acting when the latch lever is released, in accordance with a preferred embodiment.

FIG. 11 illustrates a top view of the hinged, rotatable binding system 900 shown with a von mises stress 910 acting when the latch lever 425 is released, in accordance with a preferred embodiment. In an elastic body that is subject to a system of loads in three dimensions, a complex three dimensional system of stresses is developed. That is, at any point within the body there are stresses acting in different directions, and the direction and magnitude of stresses changes from point to point. The Von Mises criterion is a formula for calculating whether the stress combination at a given point will cause failure. The maximum von mises stress that the hinged, rotatable binding system 900 can hold when the latch lever 425 released is equal to 417.6 psi.

The snowboard binding systems can be made of materials like 01 tool steel, 6061 aluminum and magnesium that used in the snowboard binding systems whose tensile strength, yield strength and density are as mentioned in the following table.

| Material | Tensile Strength | Yield Strength | Density |
|---|---|---|---|
| 01 Tool Steel | 84,000 psi | 70,000 psi | .31 lb/in$^3$ |
| 6061 Aluminum | 45,000 psi | 40,000 psi | .098 lb/in$^3$ |
| Magnesium | 34,000 psi | 23,000 psi | .065 lb/in$^3$ |

It is believed that utilizing the system described herein, relieves knee and ankle pain for snowboarders while in lift lines and on the chair lift. The system described herein also can be adapted for rotating the front binding to a parallel position and to reduce discomfort and injury when loading/unloading from chairlift.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A snowboard, comprising:

a single board including a fixed binding mounted on a topside of the snowboard and mostly perpendicular to a tip of said single board and further comprising a hinged, rotatable binding mounted on the topside of the single board, wherein said one fixed binding and said hinged, rotatable binding are mostly parallel during use of said single board by a user with feet of the user contained in boots and firmly mounted to the one fixed binding and the hinged, rotatably binding to descend down a snow covered hillside, and wherein said hinged, rotatable binding is moveable to a position mostly perpendicular to said fixed binding when a human user has only one foot mounted to the single board at said hinged, rotatable binding and the user is shuffling through a chairlift line or riding on a chairlift, said hinged, rotatable binding further comprising:

a base plate which is mounted to the snowboard, a mid static disk coupled to said base plate by a hinge plate, said mid static disk rotationally coupled to a top rotating disk, wherein said top rotating disk mountable to the bottom of an integrated boot binding harness, and wherein said mid static disk acts as coupling between said snowboard and said top rotating disk and wherein said hinge plate further comprising a double hinge connecting said mid static disk and said base plate which supports rotation of said top rotating disk via said mid static disk relative to said base plate and snowboard, wherein said hinge plate further enables double hinge movement of said boot binding harness away from said snowboard at a toe area; and a latch lever mounted through an outer ridge of said base plate and connected to a retractable plunger using a retractable connection wherein said latch lever acts as a locking and release system for maintaining said top rotating disk parallel with said base plate or releasing said top rotating disk for rotation up to a 90 degrees with respect to said base plate via said mid static disk.

2. The snowboard of claim 1, further comprising a first hinge dowel axis for connecting said double hinge on one end to said mid static disk and a second hinge dowel for connecting said double hinge at a second end to said base plate.

3. The snowboard of claim 1, wherein said retractable plunger is mounted through a hole formed in said base plate in connection with said latch lever, and further interacts with a top slot formed in said top rotating disk.

4. The snowboard of claim 1, wherein said base plate and said snowboard are mounted together using at least one base plate bolt.

5. The snowboard of claim 1, wherein said top rotating disk and said mid static disk are rotatably mounted to each other with a center axis bolt.

6. The snowboard of claim 2, wherein a spring plunger is used to mount said latch lever through a hole formed in said base plate.

7. The snowboard of claim 3, wherein retractable plunger operates as a retractable connection to enable retraction of said retractable plunger from locked engagement of said top rotating disk and said boot binding harness with said base plate.

8. A snowboard binding system, comprising;

one fixed binding and one hinged, rotatable binding mounted to one snowboard, wherein feet of a user are contained in boots and are each firmly mounted to the one fixed binding and the hinged, rotatably binding to descend down a snow covered hillside, and wherein said hinged, rotatable binding is moveable to a position mostly perpendicular to said fixed binding when a human user has only one foot mounted to the single board at said hinged, rotatable binding and the user is shuffling through a chairlift line or riding on a chairlift;

a base plate mounted to a snowboard which is further connected via a hinge plate to a mid static disk said hinge plate further comprising two hinges connecting the mid static disk to a top rotating disc, wherein said hinge plate enables said snowboard to rotate away from a toe area of a user boot contained within the boot binding harness given rotably connection of the mid static disk and the top rotating disc and the hinged connection of said mid static disk and said base plate; and a locking mechanism configured to selectively lock said top rotating disk to said base plate or release said top rotating disk from said base plate to allow rotation of said top rotating disk up to ninety degrees with respect to said base plate.

9. The snowboard binding system of claim 8, wherein said locking mechanism further comprises a retractable plunger that enables retraction of said retractable plunger from engagement with a top rotating disk.

10. The snowboard binding system of claim 8, wherein said top rotating disk is mounted on said base plate using a center axis bolt.

11. The snowboard binding system of claim 8, wherein said base plate is mounted on the snowboard using a plurality of base bolts.

12. The snowboard binding system of claim 8, wherein said mid-static disk acts as a support plate to said top rotating disk.

13. The snowboard binding system of claim 8, wherein said retractable plunger is mounted through a hole formed in said base plate in connection with said latch lever, and further interacts through said lock base plate with a top slot formed in said top rotating disk.

14. A snowboard binding system, comprising:

one fixed binding and one hinged, rotatable binding system mounted to a snowboard, wherein feet of a user are contained in boots and are each firmly mounted to the one fixed binding and the hinged, rotatably binding to descend down a snow covered hillside, and wherein said hinged, rotatable binding is moveable to a position mostly perpendicular to said fixed binding when a human user has only one foot mounted to the single board at said hinged, rotatable binding and the user is shuffling through a chairlift line or riding on a chairlift, said hinged, rotatable binding system for a snowboard further comprising:

a base plate attached on a snowboard with a plurality of base bolts;

a mid static disk coupled to said base plate by a hinge plate and rotatably coupled to a top rotatable disk by a center access bolt, wherein said top rotatable disk can rotate up to 90° relative to said base plate, wherein said top rotating disk is mountable to a boot binding harness having a toe area and heel area and wherein said hinge plate further includes a hinge at a first end attached to said base plate and a hinge at a second end attached to said top rotating disk near said toe area of said boot binding harness, wherein said hinge plate providing hinged action that enables a snowboard to rotate away from said boot binding harness at said toe area with respect to said snowboard; and a latch lever located on an outer ridge of said base plate for use as a locking system for said top plate to said base plate.

15. The snowboard binding system of claim 14, wherein said mid-static disk is connected with said base plate for supporting said top rotating disk.

16. The snowboard binding system of claim 14, further comprising a retractable plunger mounted through a hole formed in said base plate and in connection with said latch lever, and further interacts at a top slot formed in said top rotating disk.

17. The snowboard binding system of claim 14, wherein said top rotating disk is rotatable up to 90° with respect to said base plate.

18. The snowboard binding system of claim 14, wherein said base plate connects a hinge plate dowel axis connecting said base plate to said mid static disk.

19. The snowboard binding system of claim 14, wherein said top plate rotates up to 90° to palliate stress at anatomic areas of user's foot and ankle.

20. The snowboard binding system of claim 17, wherein said locking system can be locked at desired angle up to 90°.

21. A snowboard having a one fixed binding and one hinged, rotatable binding system, wherein feet of a user are contained in boots and are each firmly mounted to the one fixed binding and the hinged, rotatably binding to descend down a snow covered hillside, and wherein said hinged, rotatable binding is moveable to a position mostly perpendicular to said fixed binding when a human user has only one foot mounted to the single board at said hinged, rotatable binding and the user is shuffling through a chairlift line or riding on a chairlift, said snowboard further comprising:

a base plate mountable to a snowboard and hingedly connected to a mid static disk that is further connected rotatably by a center bolt to a top rotating disk wherein a hinge plate enables a double hinge action and connects said base plate via the mid static disk to the top rotating disc; and a spring plunger mounted through said base plate by a latch lever in retractable connection with a top slot formed in said top rotating disk wherein said latch lever is mounted on an outer ridge of said base plate for locking and unlocking said hinged, rotatable binding system via said spring plunger.

22. The hinged, rotatable binding system of claim 21, wherein said hinged rotatable binding system relieves stress at a plurality of anatomic areas comprises a knee extension, an ankle dorsiflexion and an ankle supination.

23. A snowboard having a one fixed binding and one hinged, rotatable binding system, said hinged, rotatable binding system for a snowboard further comprising:

a snowboard wherein feet of a user are contained in boots and are each firmly mounted to the one fixed binding and the hinged, rotatably binding to descend down a snow covered hillside, and wherein said hinged, rotatable binding is moveable to a position mostly perpendicular to said fixed binding when a human user has only one foot mounted to the single board at said hinged, rotatable binding and the user is shuffling through a chairlift line or riding on a chairlift, said snowboard further comprising a base plate mounted to said snowboard using a plurality of locking dowels, a mid static disk hingedly connected to the base plate by a supporting hinge plate and a top rotating disk rotatably connected to said mid static disk by a center bolt, wherein said top rotating disk is mountable to a boot binding harness; and a latch lever mounted on a outer ridge of said base plate wherein said latch lever is further connected to a spring plunger to enable retraction of said spring plunger from engagement with said top rotating disk wherein said top rotating disk allows a snowboarder to rotate a front binding up to ninety degrees with respect to said base plate to a parallel position with respect to the snowboard for ease of snowboarder mobility when shuffling along in a chairlift line.

24. The hinged and rotatable snowboard binding system of claim 23, wherein said snowboard system enables the snowboard to rotate and swing away from a user foot when the snowboard is attached to said user foot while on chair lifts and rorate up to ninety degrees with respect to said snowboard while in movements through lift lines thereby reducing discomfort and torque in the user's ankle.

25. The hinged and rotatable snowboard binding system of claim 24, wherein said latch lever is connected to said base plate and is further connected to and controls operation of said retractable spring plunger to enable retraction of said spring plunger from engagement with said top rotating disk.

* * * * *